US010425995B2

(12) United States Patent
Kim et al.

(10) Patent No.: US 10,425,995 B2
(45) Date of Patent: Sep. 24, 2019

(54) PTC HEATER

(71) Applicants: Halla Visteon Climate Control Corp., Daejeon (KR); Woory Industrial Company, Ltd., Gyeonggi-do (KR)

(72) Inventors: Hak Kyu Kim, Daejeon (KR); Sung Ho Kang, Daejeon (KR); Sang Ki Lee, Daejeon (KR); Jung Jae Lee, Daejeon (KR); Jae Min Lee, Daejeon (KR); Young Ho Choi, Daejeon (KR); Sung Young Lee, Gyeonggi-do (KR)

(73) Assignee: HANON SYSTEMS, Daejeon-si (KR)

( * ) Notice: Subject to any disclaimer, the term of this patent is extended or adjusted under 35 U.S.C. 154(b) by 699 days.

(21) Appl. No.: 14/587,124

(22) Filed: Dec. 31, 2014

(65) Prior Publication Data

US 2015/0189700 A1 Jul. 2, 2015

(30) Foreign Application Priority Data

Dec. 31, 2013 (KR) ..... 10-2013-0168570

(51) Int. Cl.
*H05B 3/82* (2006.01)
*H05B 1/02* (2006.01)
*H05B 3/24* (2006.01)

(52) U.S. Cl.
CPC ..... *H05B 3/82* (2013.01); *H05B 1/0236* (2013.01); *H05B 3/24* (2013.01); *H05B 2203/02* (2013.01); *H05B 2203/023* (2013.01)

(58) Field of Classification Search
CPC ..... H05B 3/82; H05B 1/0236; H05B 3/24; H05B 2203/02; H05B 2203/023; H05B 3/0038; H05B 3/0042
USPC ..... 219/539, 201, 202, 520, 536, 537, 538, 219/540, 541, 544, 553, 504, 483, 486
See application file for complete search history.

(56) References Cited

U.S. PATENT DOCUMENTS 5,560,851 A * 10/1996 Thimm ..... H05B 3/141 219/543
2007/0114217 A1* 5/2007 Bohlender ..... F24H 3/0405 219/202
2008/0135535 A1* 6/2008 Brun ..... B60H 1/2225 219/202
2010/0012640 A1* 1/2010 Hetzler ..... B60H 1/2225 219/202
2010/0108661 A1* 5/2010 Vontell ..... H05B 3/34 219/477
2013/0163969 A1* 6/2013 Bohlender ..... F24H 1/0018 392/465

FOREIGN PATENT DOCUMENTS

KR 1020100078165 A 7/2010

* cited by examiner

*Primary Examiner* — Tu B Hoang
*Assistant Examiner* — Masahiko Muranami
(74) *Attorney, Agent, or Firm* — Shumaker, Loop & Kendrick, LLP; James D. Miller

(57) ABSTRACT

A positive temperature coefficient heater includes PTC elements embedded in adjacent heat rods, the PTC elements of the adjacent heat rods include center lines mismatched with each other and configured to minimize regions in which the PTC elements are overlapped with each other in the heat rods in which a plurality of PTC elements spaced apart from each other so as to form columns and rows and arranged in a single layer are embedded.

16 Claims, 10 Drawing Sheets

PTC HEATER

CROSS-REFERENCE TO RELATED APPLICATIONS

This application claims priority under 35 U.S.C. § 119 to Korean Patent Application No. 10-2013-0168570, filed on Dec. 31, 2013, in the Korean Intellectual Property Office, the disclosure of which is incorporated herein by reference in its entirety.

TECHNICAL FIELD

The following disclosure relates to a positive temperature coefficient (PTC) heater. More particularly, the following disclosure relates to a PTC heater having PTC elements spaced apart from each other so as to form columns and rows and embedded in a single layer in each of adjacent heat rods of the PTC heater. The PTC heater is capable of decreasing noise generated by a pulse width modulation (PWM) control by disposing center lines, in a height direction, of the PTC elements embedded in adjacent heat rods so as to be mismatched with each other. Mismatched center lines of the PTC elements embedded in the adjacent heat rods minimizes regions in which the PTC elements are overlapped with each other in the adjacent heat rods.

BACKGROUND

Various vehicles are provided with an air conditioning system for selectively supplying cool air and warm air to each portion of the interior of the vehicles. During the summer, an air conditioner is operated to supply the cool air, and during the winter, a heater is operated to supply the warm air.

Generally, the heater is operated in a scheme in which a coolant heated while being circulated in an engine and air introduced by a fan are heat-exchanged with each other to supply the warm air to the interior of the vehicle, thereby performing heating. In this heating scheme, heat generated by the engine is used, and thus, energy efficiency is high.

However, during the winter, a predetermined time is required until the engine is heated after starting the vehicle, and then, the heating is not made immediately after starting the vehicle. Therefore, the engine is idled for a predetermined time before being driven until the engine is heated for heating and a temperature of the coolant becomes high, such that problems such as waste of energy and environmental pollution have occurred.

In order to prevent these problems, a method of heating the interior of the vehicle using a separate preheater for a predetermined time in which the engine is heated has been used. A heater using a heating coil according to the related art has a high heat generation amount, such that heating is effectively performed. However, a fire risk is high, and a lifespan of an electric heating wire is short, such that repair and replacement of components are frequently generated, which is inconvenient.

Therefore, a PTC heater, using a positive temperature coefficient (PTC) element, allows the heating to be performed using electric energy of a battery as an auxiliary heating apparatus for heating at the early stage of starting has been used.

The PTC heater may be semi-permanently used due to a low fire risk and a long lifespan. A PTC heater having a relatively small capacity has been mainly used. Recently, a PTC heater having a high capacity has been demanded and developed depending on necessity of users and various kinds of vehicles including an electric vehicle.

A turn on/off of the PTC heater generally controls a capacity in a pulse width modulation (PWM) scheme through a controller.

The PWM scheme, which is one of pulse modulation schemes, indicates a scheme of performing a control by changing a duty ratio of a pulse depending on a magnitude of a modulation signal. That is, the PWM scheme adjusts a control value by adjusting the duty ratio. In this case, the duty ratio of the pulse signal is changed, such that an average value of the pulse signal is changed, and this average value is used as a control signal value.

Korean Patent Laid-Open Publication No. 2010-0078165, published on Jul. 8, 2010, entitled "Air Conditioner for Vehicles and Control Method Thereof" discloses a technology for controlling a heat generation amount of a PTC heater through a control of a PWM signal.

However, at the time of a high voltage PTC heater operation, in the case of the PTC element, noise due to vibrations is generated. Particularly, high frequency noise is generated as an operating frequency becomes higher.

Here, a main noise source is due to vibrations of the PTC element. As shown in FIG. 1, in the case in which the PTC elements 20 are disposed at the same positions in adjacent heat rods 10 to thereby be overlapped with each other, the PTC elements collide with each other by PTC vibrations, such that the noise is increased.

In addition, the noise is increased as a capacity of the PTC heater becomes larger, a size of the PTC heater to a capacity of the PTC heater becomes smaller, or a distance between the heat rods 10 becomes narrower. In this case, the PTC elements generate heat, such that the possibility that the PTC heater will be thermally saturated, and an efficiency of the PTC heater may be decreased.

SUMMARY

An embodiment of the present invention is directed to providing a positive temperature coefficient (PTC) heater capable of decreasing noise generated by a pulse width modulation (PWM) control by disposing center lines, in a height direction, of PTC elements embedded in adjacent heat rods so as to be mismatched with each other in order to minimize regions in which a plurality of the PTC elements of the PTC heater are overlapped with each other. The heat rods include the plurality of PTC elements embedded therein and spaced apart from each other so as to form columns and rows and are arranged in a single layer.

In one general aspect, a positive temperature coefficient (PTC) heater 1 includes: a plurality of heat rods 100 having a plurality of PTC elements 110 embedded therein and having terminals 120 extended and protruded from one sides thereof in a height direction. The plurality of PTC elements 110 being spaced apart from each other so as to form columns and rows and being arranged in a single layer. The terminals 120 being connected to an external power source. A plurality of heat radiation fins 200 are arranged alternately with the heat rods 100 in a length direction. An upper housing 300 and a lower housing 400 coupled, respectively, to upper and lower portions of the heat rods 100 and the heat radiation fins 200 in the height direction, Two adjacent heat rods 100 are disposed so that center lines Ca, Cb, in the height direction, of PTC elements embedded in a heat rod 100' of one column and a heat rod 100" of an other column adjacent to the heat rod 100' of one column are mismatched with each other in order to minimize regions in which the PTC elements are overlapped with each other.

At least two kinds of heat rods 100 may be arranged alternately with each other.

In the two adjacent heat rods 100, a number of the PTC elements 110 embedded in the heat rod 100' of one column and a number of the PTC elements embedded in the heat rod 100" of the other column adjacent to the heat rod 100' of one column may be the same as each other.

In the two adjacent heat rods 100, the PTC elements 110 embedded in the heat rod 100' of one column and the PTC elements 110 embedded in the heat rod 100" of the other column may have a gap formed therebetween in the height direction.

In the two adjacent heat rods 100, the numbers of the PTC elements 110 embedded in the heat rod 100' of one column and the number of the PTC elements embedded in the heat rod 100" of the other column adjacent to the heat rod 100' of one column may be different from each other.

In the two adjacent heat rods 100, gaps between the PTC elements 110 embedded in the heat rod 100' of one column and gaps between the PTC elements 110 of the heat rod 100" of the other column adjacent to the heat rod 100' of one column may be different from each other.

In the two adjacent heat rods 100, a width Wa of the PTC element embedded in the heat rod 100' of one column having a number of PTC elements 110 greater than a number of PTC elements of the heat rod 100" of the other column may be less than a width Wb of the PTC element of a heat rod 100" of the other column.

In the two adjacent heat rods 100, a capacity of the PTC elements 110 embedded in the heat rod 100' of one column and a capacity of the PTC elements 110 in the heat rod 100" of the other column adjacent to the heat rod 100' of one column may be different from each other.

In the two adjacent heat rods 100, a capacity of the PTC elements 110 embedded in the heat rod 100' of one column having a number of PTC elements greater than a number of PTC elements of the heat rod 100" of the other column may be less than a capacity of the PTC elements 110 of the heat rod 100" of the other column.

The two adjacent heat rods 100 may include insulators 130 coupled to the terminals 120 protruded outwardly, the insulators 130 of the heat rod 100' of one column and the insulators 130 of the heat rod 100" of the other column adjacent to the heat rod 100' of one column have different colors.

In the two adjacent heat rods 100, a form of a portion in which the heat rod 100' of one column is assembled to the upper housing 300 and a form of a portion in which the heat rod 100" of the other column adjacent to the heat rod 100' of one column is assembled to the upper housing 300 may be different from each other.

In the two adjacent heat rods 100, a resistance value of the PTC elements 110 embedded in the heat rod 100' of one column and a resistance value of the PTC elements 110 of the heat rod 100" of the other column adjacent to the heat rod 100' of one column may be different from each other.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE MAIN ELEMENTS

| | |
|---|---|
| 1: PTC heater | |
| 100: heat rod | |
| 100': heat rod of one column; heat rod of an odd column | |
| 100": heat rod of an other column; heat rod of an even column | |
| 110: PTC element | 120: terminal |
| 130: insulator | |
| 200: heat radiation fin | |
| 300: upper housing | |
| 310: header | |
| 400: lower housing | |
| Ca, Cb: center line | |

DETAILED DESCRIPTION OF EMBODIMENTS

Hereinafter, a positive temperature coefficient (PTC) heater according to an exemplary embodiment of the present invention will be described in detail with reference to the accompanying drawings. The following detailed description and appended drawings describe and illustrate various exemplary embodiments of the invention. The description and drawings serve to enable one skilled in the art to make and use the invention, and are not intended to limit the scope of the invention in any manner.

The present invention relates to an electric relay type PTC heater 1 operated in three and four steps depending on a turn on/off signal of an air conditioning control like a relay by using a pulse width modulation (PWM) element within the PTC heater 1 instead of a relay circuit of a vehicle.

Figure 1:
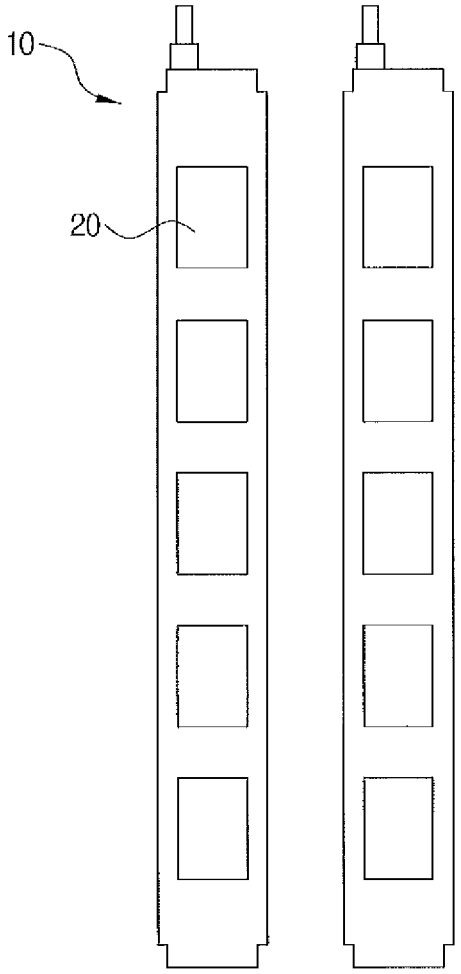
FIG. 1 Prior Art
FIG. 1 is a side elevational view showing adjacent heat rods of a positive temperature coefficient (PTC) heater according to the related art.
Figure 2:
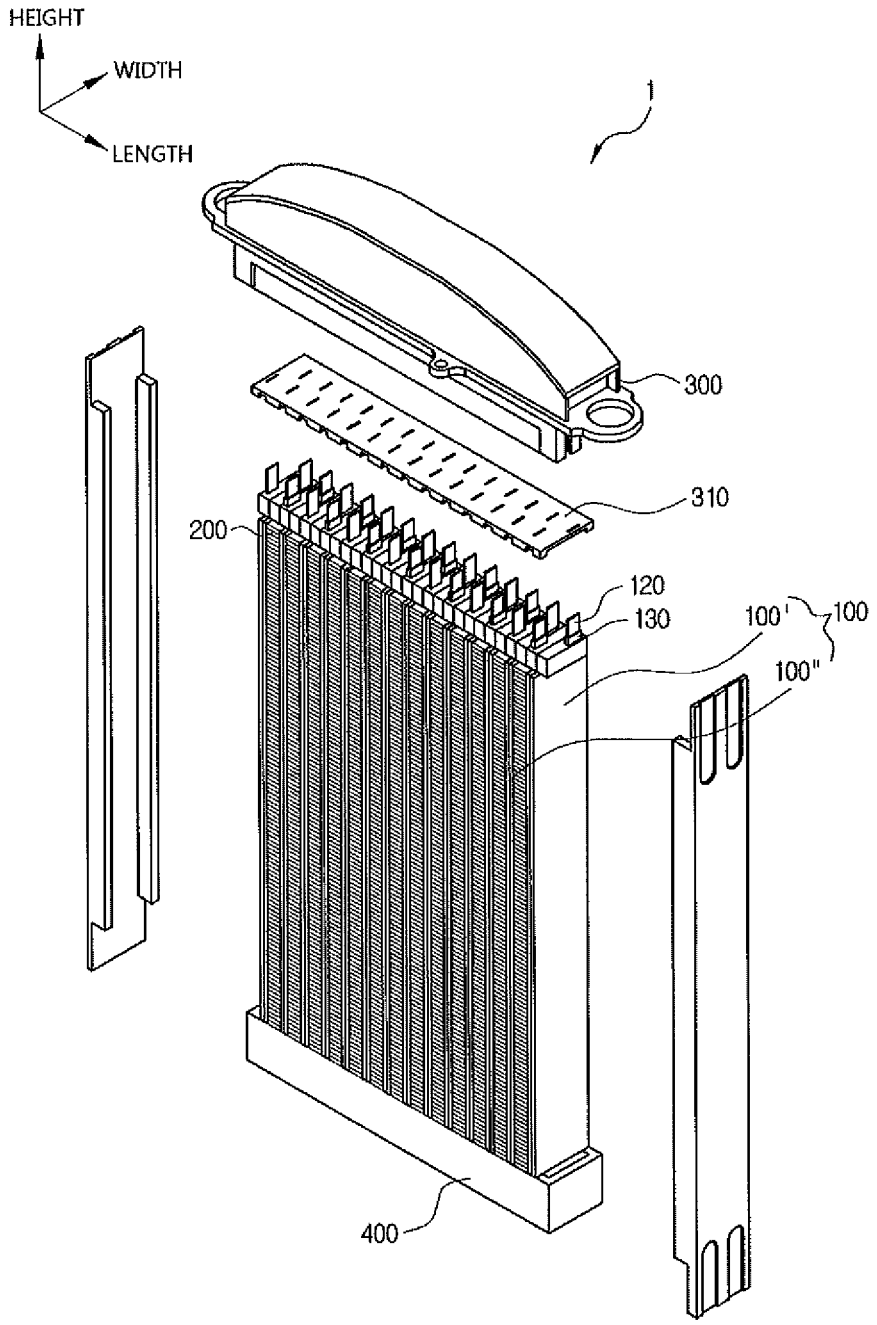
FIG. 2 is a partially exploded perspective view showing a positive temperature coefficient (PTC) heater according to an exemplary embodiment of the present invention.

FIG. 2 is a perspective view showing the PTC heater 1 according to an exemplary embodiment of the present invention. As shown in FIG. 2, the PTC heater 1 according to an exemplary embodiment of the present invention is mainly configured to include heat rods 100, an upper housing 300, a lower housing 400, and heat radiation fins 200.

Figure 3:
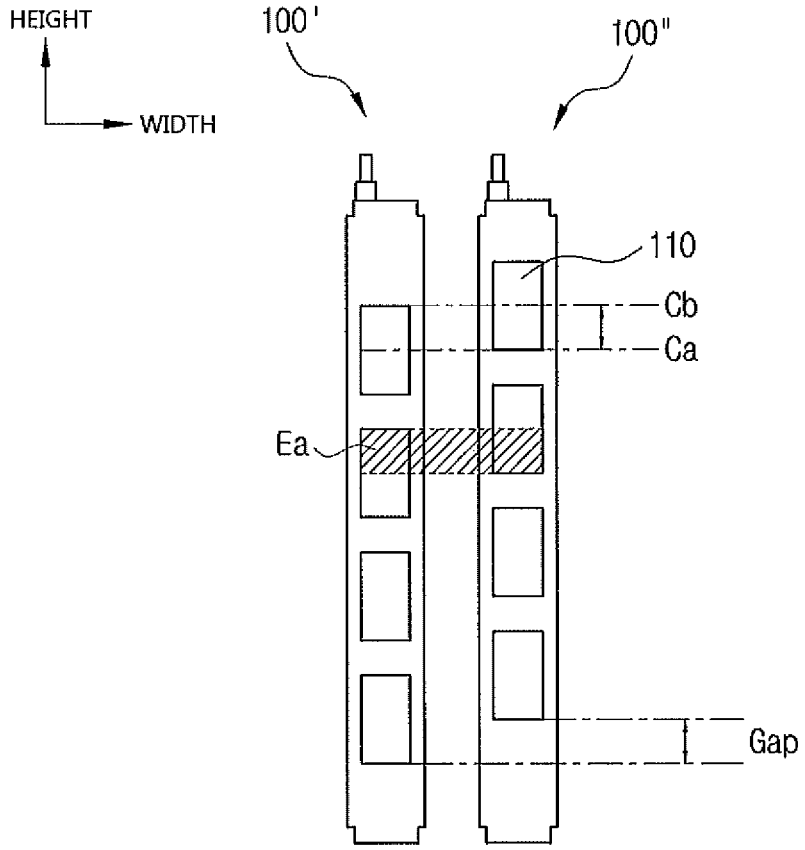
FIGS. 3 to 7 are side elevational views showing various examples of adjacent heat rods included in the PTC heater of FIG. 2 according to an exemplary embodiment of the present invention.

As shown in FIGS. 2-3, the heat rods 100 have a plurality of PTC elements 110 embedded therein and terminals 120 extending and protruding from one side thereof in a height direction. The plurality of PTC elements 110 is spaced apart from each other and form columns and rows. The PTC elements 110 are arranged in a single layer and the terminals 120 are connected to an external power source.

The heat rods 100 are arranged so as to form a plurality of columns in a length direction of the PTC heater 1. The heat radiation fins 200 are disposed between the heat rods 100. The heat rods 100 are arranged alternately with the heat radiation fins 200 in the length direction.

Figure 5:
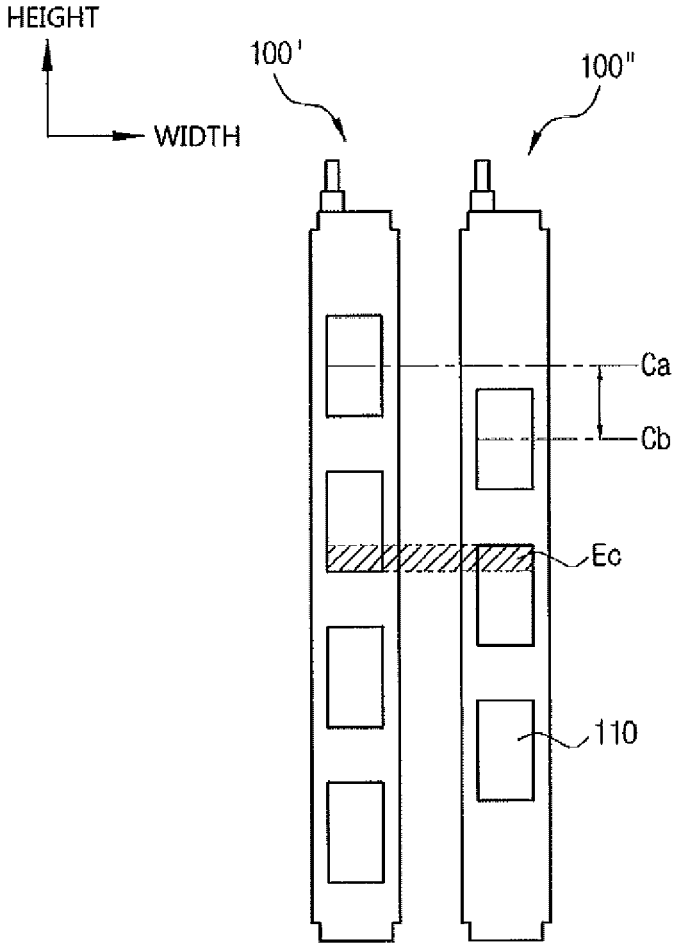

The PTC elements 110 are spaced apart from each other so as to form the columns and the rows. The FTC elements 110 are arranged in a single layer, as shown in FIG. 5. Although the case in which the plurality of PTC elements 110 form one layer has been shown in FIG. 5, a number of columns, a number of rows, a number of spaced gaps, and the like, may be appropriately determined depending on factors such as desired heat generation performance, a volume of a space in which the PTC heater 1 is to be disposed, and the like. For example, the plurality of PTC elements 110 may form two or three or more columns.

Particularly, as shown in FIGS. 3-7, the heat rods 100 are characterized in that they are disposed so a center line Ca, in the height direction, of the PTC elements 110 embedded in a heat rod 100' of one column of the heat rods 100 is mismatched with a center line Cb, in the height direction, of the PTC elements 110 embedded in a heat rod 100" of an other column of the heat rods 100 adjacent the heat rod of the odd column 100'. The centerlines Ca, Cb are mismatched in order to minimize regions in which the PTC elements 110 are overlapped with each other.

The upper housing 300 supports and fixes a first end portion of each of the heat rods 100 and each of the heat radiation fins 200 in the height direction. The upper housing 300 supplies power to the terminals 120 of the heat rods 100, and has a control substrate accommodated therein. The control substrate has an element mounted thereon in order to control the supplied power.

The lower housing 400 supports and fixes a second end portion of each of the heat rods 100 and each of the heat radiation fins 200 in the height direction.

As described above, generally, the heat rods 100 and the heat radiation fins 200 are arranged alternately with each other in the length direction in the PTC heater 1. In the related art, there was a problem that the PTC elements 110 are disposed at the same positions in each of the heat rods 100 and the numbers of PTC elements 110 embedded in each of the heat rods 100 are the same as each other, such that the PTC elements 110 collide with PTC elements 110 embedded in an adjacent heat rod 100 by vibrations generated at the time of performing a PWM control of the PWM element to increase noise.

Therefore, as described above, in the PTC heater 1 according to an exemplary embodiment of the present invention, the PTC elements 110 in each of the adjacent heat rods 100 are disposed so as to be mismatched with each other, thereby minimizing the regions in which the PTC elements 110 are overlapped with each other.

That is, the PTC elements 110 embedded in the heat rod 100' of the one column and the heat rod 100" of the other column are disposed so that the center lines Ca, Cb thereof, in the height direction, are mismatched with each other.

In this case, regions of each of the PTC elements 110 of each of the heat rods 100 overlapped with each other are decreased as compared with the case in which the center lines Ca, Cb coincide with each other.

FIG. 3 shows adjacent heat rods 100 included in the PTC heater 1 according to an exemplary embodiment of the present invention. Hereinafter, for convenience of explanation, a heat rod 100 positioned at the left will be referred to as a heat rod 100' of an odd column, and a heat rod 100 positioned at the right will be referred to as a heat rod 100" of an even column.

An example in which the number of PTC elements 110 embedded in the heat rod 100' of the odd column and the number of PTC elements 110 embedded in the heat rod 100" of the even column are the same and positions of the PTC elements 110 are mismatched with each other is shown in FIG. 3.

Figure 4:
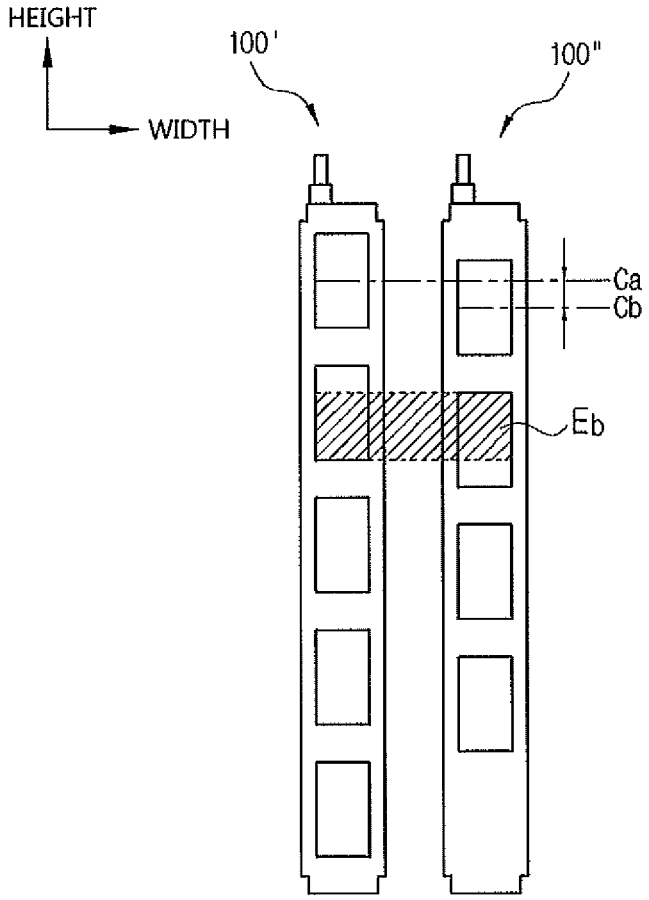

An example in which five PTC elements 110 are disposed in the heat rod 100' of the odd column and four PTC elements 110 are disposed in the heat rod 100" of the even column is shown in FIG. 4. An example in which four PTC elements 110 are disposed in the heat rod 100' of the odd column and three PTC elements 110 are disposed in the heat rod 100" of the even column is shown in FIG. 5.

An area Ea in which a one of the PTC elements 110 embedded in the heat rod 100' of the odd column and one of the PTC elements 110 embedded in the heat rod 100" of the even column are overlapped with each other is shown in FIG. 3. An area Eb in which one of the PTC elements 110 embedded in the heat rod 100' of the odd column and one of the PTC elements 110 embedded in the heat rod 100" of the even column are overlapped with each other is shown in FIG. 4. An area Ec in which one of the PTC elements 110 embedded in the heat rod 100' of the odd column and one of the the PTC elements 110 embedded in the heat rod 100" of the even column are overlapped with each other is shown in FIG. 5. Sizes of the areas Ea, Eb, Ec in which the PTC elements 110 are overlapped with each other satisfy the following Equation: Eb>Ea>Ec.

That is, the smaller the number of the PTC elements 110 disposed in a pair of heat rods 100', 100", the smaller the area in which the PTC elements 110 are overlapped with each other. It may be considered preferable, in terms of a noise decrease, that the number of the PTC elements 110 is small. It is not unconditionally preferable that the number of the PTC elements 110 is small when considering a heat generation capacity of the PTC heater 1. Therefore, in the PTC heater 1, according to an exemplary embodiment of the present invention, the number of the PTC elements 110 needs to be appropriately adjusted in consideration of both of the noise and the heat generation capacity.

As shown in FIG. 5, the heat rod 100' of the odd column may be arranged so that the number of the PTC elements 110 embedded therein is more than the number of the PTC elements 110 embedded in a heat rod 100" of the even column adjacent to the heat rod 100' of the odd column by one in order to minimize the area in which the PTC elements 110 are overlapped with each other.

That is, four PTC elements 110 may be disposed in the heat rod 100' of the odd column, and three PTC elements 110 may be disposed in the heat rod 100" of the even column.

Here, resistance values of the PTC elements 110 embedded in the heat rod 100' of the odd column and the PTC elements 110 embedded in the heat rod 100" of the even column may be changed in order to prevent a decrease in the heat generation capacity of the PTC heater 1 due to a decrease in the number of PTC elements 110 while uniformly maintaining temperatures of each part.

That is, the heat rod 100' of the odd column may have a large number of PTC elements 110, but have a relatively small heat generation capacity, and the heat rod 100" of the even column may have a small number of PTC elements, but have a relatively large heat generation capacity.

As an example, the PTC elements 110 embedded in the heat rod 100' of the odd column may have a resistance of about 2KΩ, and the PTC elements 110 embedded in the heat rod 100" of the even column may have a resistance of about 5KΩ.

Figure 6:
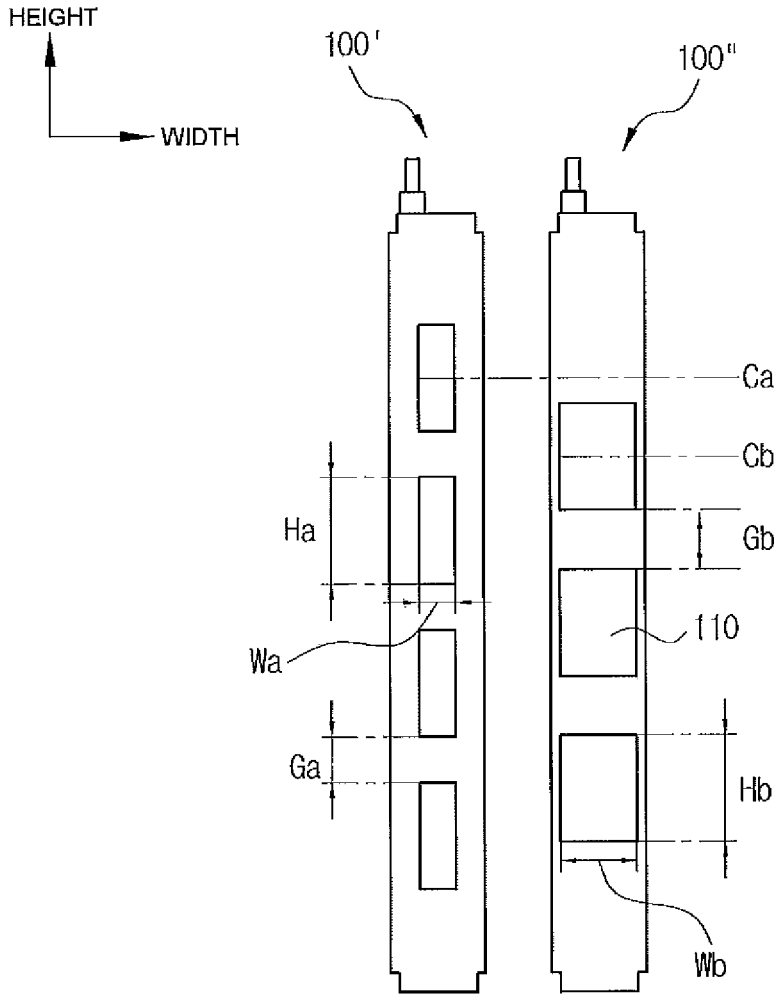

In addition, as shown in FIG. 6, in two adjacent heat rods 100', 100", a width Wa of the PTC elements 110 of the heat rod 100' having a larger number of PTC elements 110 may be smaller than a width Wb of the PTC elements 110 of the heat rod 100" having a smaller number of PTC elements 110.

The heat rod 100' of the odd column may have a large number of the PTC elements 110 with each of the PTC element 110 having a small width Wa. The heat rod 100" of the even column may have a small number of the PTC elements 110 with each of the PTC elements having a large width Wa. A height Ha of each of the PTC elements of the heat rod 100' of the odd column is equal to a height Hb of each of the PTC elements of the heat rod 100" of the even column. (Ha=Hb and Wa<Wb).

In addition, as shown in FIG. 6, the PTC elements 110 embedded in the heat rod 100' of the odd column may be disposed from each other by a gap Ga formed therebetween. The gap Ga between the PTC elements 110 of the heat rod 100' of the odd column is narrower than a gap Gb between the PTC elements 110 embedded in the heat rod 100" of the even column adjacent to the heat rod 100' of the odd column. In other words, since the four PTC elements 110 are disposed in the heat rod 100' of the odd column and the three PTC elements 110 are disposed in the heat rod 100" of the even column, the gap Ga between the PTC elements 110 embedded in the heat rod 100' of the odd column can be narrower than a gap Gb between the PTC elements 110 embedded in the heat rod 100" of the even column.

Figure 7:
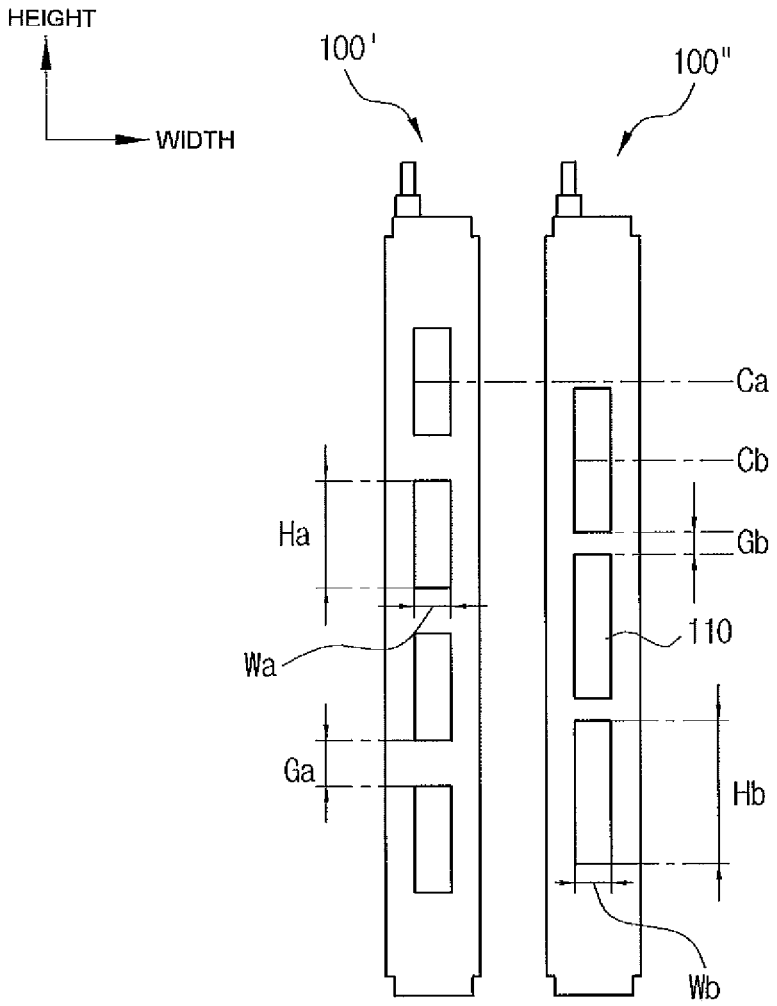

In addition, as shown in FIG. 7, in the two adjacent heat rods 100', 100", the length Ha of the PTC elements of the heat rod 100' of the odd column having a larger number of PTC elements 110 may be shorter than the length Hb of the PTC element of the heat rod 100" of the even column having a smaller number of PTC elements 110 (Ha<Hb and Wa=Wb).

Further, the heat rod 100' of the odd column may have a large number of the PTC elements 110, wherein the PTC elements 110 have a thin thickness. The heat rod 100" of the even column may have a small number of PTC elements 110, wherein the PTC elements 110 have a relatively thick thickness.

As described above, any one or more of the widths, the lengths, and the thicknesses of the PTC elements 110 are made to be different from each other to change areas or volumes or change resistance values of the PTC elements 110, thereby making it possible to prevent the decrease in the heat generation capacity due to the decrease in the number of PTC elements 110 and uniformly maintain the temperatures of each part.

Meanwhile, in an exemplary embodiment of the present invention, since the numbers and the positions of the PTC elements 110 embedded in the heat rod 100' of the odd column and the numbers and positions of the PTC elements 110 embedded in the heat rod 100" of the even column are different from each other, attention needs to be paid at the time of assembling the heat rods 100 to the upper housing 300.

Figure 8:
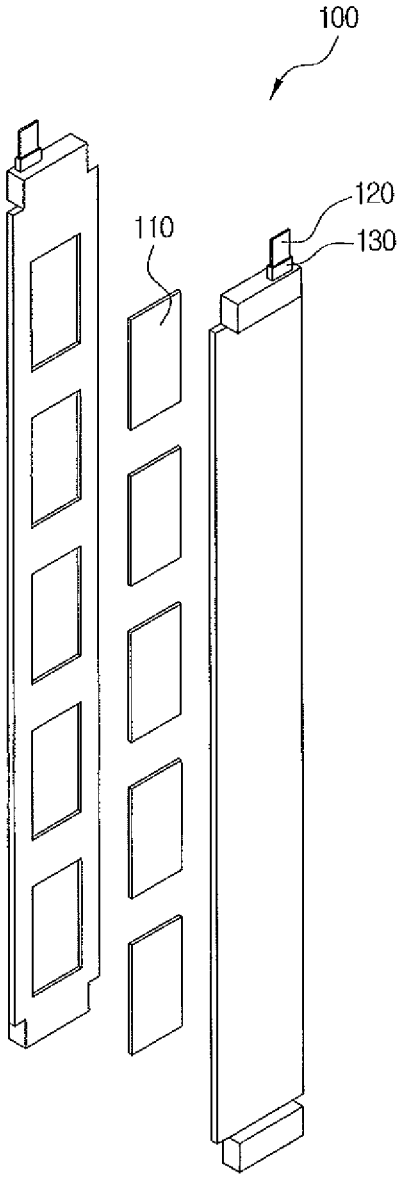
FIGS. 8 and 9 are, respectively, an exploded perspective view and an assembled perspective view showing a heat rod of the PTC heater of FIG. 2 according to an exemplary embodiment of the present invention.
Figure 9:
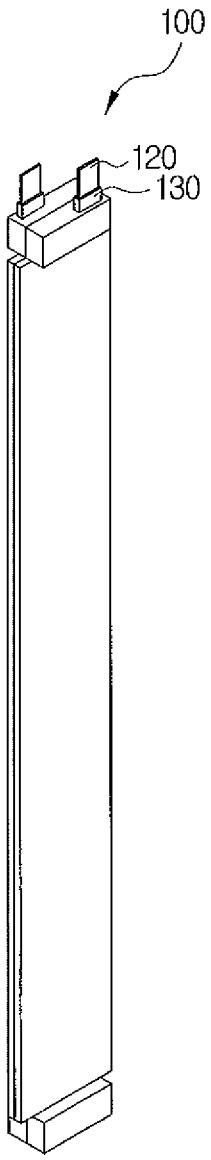
Figure 11:
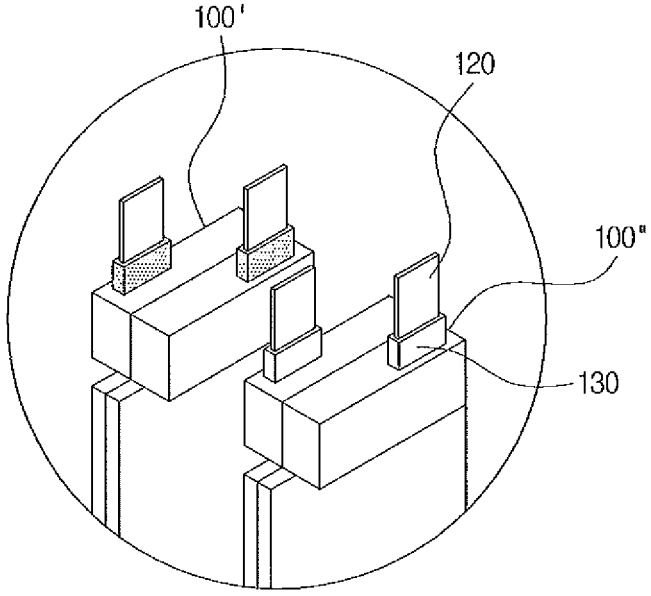

Therefore, each of the heat rods 100 includes insulators 130 coupled to the terminals 120 protruding outwardly in order to prevent misassembling, as shown in FIGS. 8 and 9. The insulator 130 of the heat rod 100' of the odd column and the insulator 130 of the heat rod 100" of the even column may have different colors, as shown in FIG. 11.

As another example, a form of a portion in which the heat rod 100' of the odd column is assembled to the upper housing 300 and a form of a portion in which the heat rod 100" of the other column adjacent to the heat rod 100' of one column is assembled to the upper housing 300 may be different from each other.

Figure 10:
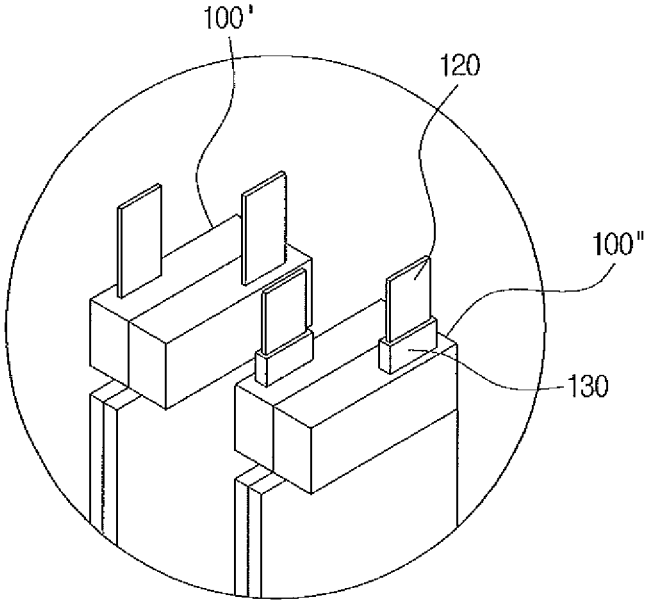
FIGS. 10 and 11 are fragmentary perspective views showing various examples of a heat rod included in the PTC heater of FIG. 2 according to an exemplary embodiment of the present invention.

In detail, each of the heat rods 100 includes the insulators 130 coupled to the terminals 120 protruding outwardly, as shown in FIGS. 8 and 9. The insulator 130 of the heat rod 100' of the odd column and the insulator 130 of the heat rod 100" of the even column may have different shapes, as shown in FIG. 10. In addition, various modifications may be made. For example, the terminals 120 may be formed so as to have different shapes.

In this case, in a header 310 (as shown in FIG. 2) to which the terminals of the heat rods 100 are coupled, a coupling hole to which the heat rod 100' of the odd column is coupled and a coupling hole to which the heat rod 100" of the even column is coupled have different shapes, thereby making it possible to fundamentally block misassembling.

In summary, the PTC heater 1 according to an exemplary embodiment of the present invention may decrease the noise generated by the PWM control by disposing the center lines Ca, Cb, in the height direction, of the PTC elements 110 embedded in the adjacent heat rods 100 so as to be mismatched with each other. The mismatched center lines Ca, Cb minimize the regions in which the PTC elements 110 of one of the adjacent heat rods 100 are overlapped with the PTC elements 110 of an other one of the adjacent heat rods 100. The plurality of PTC elements 110 is spaced apart from each other and forms the columns and the rows. The plurality of PTC elements 110 is embedded in each of the heat rods 100 in a single column.

In other words, in an exemplary embodiment of the present invention, the PTC elements 110 mounted in each of the adjacent heat rods 100 are not positioned at the same positions. The PTC elements 110 mounted in one of the adjacent rods 100 are disposed so as to be mismatched with the PTC elements 110 mounted in the other one of the adjacent rods, wherein the regions in which the PTC elements 110 embedded in the adjacent heat rods 100 are overlapped with each other may be minimized, thereby making it possible to decrease the noise generated due to the vibrations of the PTC elements 110 at the time of controlling a PWM duty for the purpose of a high voltage PTC operation.

Here, in an exemplary embodiment of the present invention, the number of the PTC elements 110 embedded in the heat rod 100' of the odd column and the number of the PTC elements 110 embedded in the the heat rod 100" of the even column are made to be different from each other in order to secure a space. The heat generation capacities of the PTC elements 110 embedded in the heat rod 100' of the odd column and the heat generation capacities of the PTC elements 110 embedded in the heat rod 100" of the even column are made to be different from each other, thereby making it possible to uniformly maintain the temperatures of each part.

Further, in an exemplary embodiment of the present invention, the regions in which the PTC elements 110 mounted in the adjacent heat rods 100 are overlapped with each other are minimized to lower a thermal saturation, thereby making it possible to improve operation efficiency.

The PTC heater 1 according to an exemplary embodiment of the present invention may decrease the noise generated by the PWM control by disposing the center lines C, Cb, in the height direction, of the PTC elements 110 embedded in the adjacent heat rods 100 so as to be mismatched with each other in order to minimize the regions in which the PTC elements 110 are overlapped with each other in the adjacent heat rods 100. The plurality of PTC elements 110 of the PTC heater 1 are spaced apart from each other so as to form the columns and the rows and arranged in the single column in each of the heat rods 100.

In other words, in an exemplary embodiment of the present invention, the PTC elements 110 mounted in the adjacent heat rods 100 are not positioned at the same positions, but are disposed so as to be mismatched with each other, such that the regions in which the PTC elements 110 embedded in the adjacent heat rods 100 are overlapped with each other may be minimized, thereby making it possible to decrease the noise generated due to the vibrations of the PTC elements 110 at the time of controlling the PWM duty for the purpose of the high voltage PTC operation.

Here, in an exemplary embodiment of the present invention, the number of the PTC elements 110 embedded in the heat rod 100' of the odd column and the number of the PTC elements 110 embedded in the heat rod 100" of the even column are made to be different from each other in order to secure the space. The heat generation capacities of the PTC elements 110 embedded in the heat rod 100' of the odd column and the heat generation capacities of the PTC elements 110 embedded in the heat rod 100" of the even column are made to be different from each other, thereby making it possible to uniformly maintain the temperatures of each part.

Further, in an exemplary embodiment of the present invention, the regions in which the PTC elements 110 mounted in the adjacent heat rods 100 are overlapped with each other are minimized to lower the thermal saturation, thereby making it possible to improve the operation efficiency.

The present invention is not limited to the above-mentioned exemplary embodiments but may be variously applied, and may be variously modified by those skilled in the art to which the present invention pertains without departing from the gist of the present invention claimed in the claims.

What is claimed is:

1. A positive temperature coefficient heater comprising:

a plurality of heat rods extending longitudinally in a first direction and spaced from each other in a second direction arranged perpendicular to the first direction, each of the plurality of heat rods having a plurality of PTC elements embedded therein and spaced apart from each other in the first direction, each of the plurality of heat rods having a terminal extending outwardly from one end thereof and configured for coupling to an external power source, each of the plurality of PTC elements including a respective center line passing through a center thereof, the center line of each of the plurality of PTC elements extending in a third direction perpendicular to the first direction and the second direction, wherein the center line of each of the plurality of PTC elements embedded in a first one of the plurality of heat rods is offset in the first direction from the center line of each of the plurality of PTC elements of a second one of the plurality of heat rods adjacent the first one of the plurality of heat rods, and each of the plurality of PTC elements embedded in the first one of the plurality of heat rods overlaps in the first direction with one or two of the plurality of PTC elements of the second one of the plurality of heat rods adjacent the first one of the plurality of heat rods when the first one of the plurality of heat rods and the second one of the plurality of heat rods are viewed from a perspective of the third direction;

a plurality of heat radiation fins disposed alternately between the plurality of heat rods, the plurality of heat radiation fins configured to transfer heat from the PTC elements in the heat rods to air flowing between the heat rods, wherein the plurality of heat radiation fins disposed between each pair of adjacent heat rods is heated asymmetrically by the PTC elements in the adjacent heat rods relative to an axis of symmetry extending in the first direction, the axis of symmetry equally spaced from each of the adjacent heat rods with respect to the second direction;

an upper housing extending longitudinally in the second direction and coupled to a first end portion of each of the plurality of heat rods; and a lower housing extending longitudinally in the second direction and coupled to a second end portion of each of the plurality of heat rods.

2. The positive temperature coefficient heater of claim 1, wherein a first region of each of the plurality of PTC elements of the first one of the plurality of heat rods overlaps with at least one region of one of the plurality of PTC elements of the second one of the plurality of heat rods with respect to the first direction when the first one of the plurality of heat rods and the second one of the plurality of heat rods are viewed from the perspective of the third direction.

3. The positive temperature coefficient heater of claim 2, wherein a second region of each of the plurality of PTC elements of the first one of the plurality of heat rods does not overlap with one of the plurality of PTC elements of the second one of the plurality of heat rods with respect to the first direction when the first one of the plurality of heat rods and the second one of the plurality of heat rods are viewed from the perspective of the third direction.

4. The positive temperature coefficient heater of claim 1, wherein the plurality of heat rods includes a plurality of first heat rods arranged alternately with a plurality of second heat rods.

5. The positive temperature coefficient heater of claim 1, wherein a number of the plurality of PTC elements of the first one of the plurality of heat rods is equal to a number of the plurality of PTC elements of the second one of the plurality of heat rods.

6. The positive temperature coefficient heater of claim 1, wherein a number of the plurality of PTC elements of the first one of the plurality of heat rods is different from a number of the plurality of PTC elements of the second one of the plurality of heat rods.

7. The positive temperature coefficient heater of claim 1, wherein a number of the plurality of PTC elements of the first one of the plurality of heat rods is greater than a number of the plurality of PTC elements of the second one of the plurality of heat rods.

8. The positive temperature coefficient heater of claim 7, wherein a heat generation capacity of the plurality of PTC elements of the first one of the plurality of heat rods is less than a heat generation capacity of the plurality of PTC elements of the second one of the plurality of heat rods.

9. The positive temperature coefficient heater of claim 1, wherein each of the first one of the plurality of heat rods and the second one of the plurality of heat rods includes a plurality of gaps formed between the plurality of PTC elements embedded therein.

10. The positive temperature coefficient heater of claim 1, wherein a heat generation capacity of the plurality of PTC elements of the first one of the plurality of heat rods is different from a heat generation capacity of the plurality of PTC elements of the second one of the plurality of heat rods.

11. The positive temperature coefficient heater of claim 1, wherein a resistance value of the plurality of PTC elements of the first one of the plurality of heat rods is different from a resistance value of the plurality of PTC elements of the second one of the plurality of heat rods.

12. The positive temperature coefficient heater of claim 11, wherein the resistance value of each of the plurality of PTC elements of the first one of the plurality of heat rods is 2 kilo ohms and the resistance value of each of the plurality of PTC elements of the second one of the plurality of heat rods is 5 kilo ohms.

13. The positive temperature coefficient heater of claim 1, wherein the first one of the plurality of heat rods includes four PTC elements and the second one of the plurality of heat rods includes three PTC elements.

14. The positive temperature coefficient heater of claim 1, wherein the first one of the plurality of heat rods includes five PTC elements and the second one of the plurality of heat rods includes four PTC elements.

15. A positive temperature coefficient heater comprising:

a plurality of heat rods extending longitudinally in a first direction and spaced from each other in a second direction arranged perpendicular to the first direction, each of the plurality of heat rods having a plurality of PTC elements embedded therein spaced apart from each other in the first direction, each of the plurality of heat rods having a terminal extending outwardly from one end thereof and configured for coupling to an external power source, each of the plurality of PTC elements including a respective center line passing through a center thereof, the center line of each of the plurality of PTC elements extending in a third direction perpendicular to the first direction and the second direction, wherein the center line of each of the plurality of PTC elements embedded in a first one of the plurality of heat rods is offset in the first direction from the center line of each of the plurality of PTC elements embedded in a second one of the plurality of heat rods adjacent the first one of the plurality of heat rods, wherein each of the plurality of PTC elements embedded in the first one of the plurality of heat rods overlaps in the first direction with one or two of the plurality of PTC elements of the second one of the plurality of heat rods adjacent the first one of the plurality of heat rods when the first one of the plurality of heat rods and the second one of the plurality of heat rods are viewed from a perspective of the third direction, and at least one region of each of the plurality of PTC elements of the first one of the plurality of heat rods does not overlap with one of the plurality of PTC elements of the second one of the plurality of heat rods with respect to the first direction when the first one of the plurality of heat rods and the second one of the plurality of heat rods are viewed from a perspective of the third direction;

a plurality of heat radiation fins disposed alternately between the plurality of heat rods, the plurality of heat radiation fins configured to transfer heat from the PTC elements in the heat rods to air flowing between the heat rods, wherein the plurality of heat radiation fins disposed between each pair of adjacent heat rods is heated asymmetrically by the PTC elements in the adjacent heat rods relative to an axis of symmetry extending in the first direction, the axis of symmetry equally spaced from each of the adjacent heat rods with respect to the second direction;

an upper housing extending longitudinally in the second direction and coupled to a first end portion of each of the plurality of heat rods; and a lower housing extending longitudinally in the second direction and coupled to a second end portion of each of the plurality of heat rods.

16. A positive temperature coefficient heater comprising:

a plurality of heat rods extending longitudinally in a first direction and spaced from each other in a second direction arranged perpendicular to the first direction, each of the plurality of heat rods having a plurality of PTC elements embedded therein spaced apart from each other in the first direction, each of the plurality of heat rods having a terminal extending outwardly from one end thereof and configured for coupling to an external power source, each of the plurality of PTC elements including a respective center line passing through a center thereof, the center line of each of the plurality of PTC elements extending in a third direction perpendicular to the first direction and the second direction, wherein the center line of each of the plurality of PTC elements embedded in a first one of the plurality of heat rods is offset in the first direction from the center line of each of the plurality of PTC elements embedded in a second one of the plurality of heat rods adjacent the first one of the plurality of heat rods, wherein a number of the plurality of PTC elements of the first one of the plurality of heat rods is greater than a number of the plurality of PTC elements of the second one of the plurality of heat rods, and each of the plurality of PTC elements embedded in the first one of the plurality of heat rods overlaps in the first direction with one or two of the plurality of PTC elements of the second one of the plurality of heat rods adjacent the first one of the plurality of heat rods when the first one of the plurality of heat rods and the second one of the plurality of heat rods are viewed from a perspective of the third direction;

a plurality of heat radiation fins disposed alternately between the plurality of heat rods, the plurality of heat radiation fins configured to transfer heat from the PTC elements in the heat rods to air flowing between the heat rods, wherein the plurality of heat radiation fins disposed between each pair of adjacent heat rods is heated asymmetrically by the PTC elements in the adjacent heat rods relative to an axis of symmetry extending in the first direction, the axis of symmetry equally spaced from each of the adjacent heat rods with respect to the second direction;

an upper housing extending longitudinally in the second direction and coupled to a first end portion of each of the plurality of heat rods and a first end portion of each of the plurality of heat radiation fins; and a lower housing extending longitudinally in the second direction and coupled to a second end portion of each of the plurality of heat rods and a second end portion of each of the plurality of heat radiation fins.

* * * * *